US005177319A

United States Patent [19]

Grimm

[11] Patent Number: 5,177,319

[45] Date of Patent: Jan. 5, 1993

[54] APPARATUS FOR LOADING SHELLS INTO TUBULAR WEAPONS, PARTICULARLY TANK HOWITZERS

[75] Inventor: Wolfgang Grimm, Augsburg, Fed. Rep. of Germany

[73] Assignee: Kuka Wehrtechnik GmbH, Augsburg, Fed. Rep. of Germany

[21] Appl. No.: 723,388

[22] Filed: Jun. 28, 1991

[30] Foreign Application Priority Data

Jun. 30, 1990 [DE] Fed. Rep. of Germany ..... 4020923

[51] Int. Cl.[5] ..... F41A 9/39

[52] U.S. Cl. ..... 89/47; 89/33.05

[58] Field of Search ..... 89/47, 45, 33.05

[56] References Cited

U.S. PATENT DOCUMENTS

| | | | |
|---|---|---|---|
| 2,933,982 | 4/1960 | Aldrin | 89/47 |
| 4,135,433 | 1/1979 | Hultgren et al. | 89/47 |
| 4,590,843 | 5/1986 | Huber | 89/36.13 |
| 4,998,458 | 3/1991 | Schiele et al. | 89/47 |

*Primary Examiner*—David H. Brown

*Attorney, Agent, or Firm*—Antonelli, Terry, Stout & Kraus

[57] ABSTRACT

An apparatus for loading shells in tubular weapons, particularly tank howitzers, comprises a linearly guided rammer engaging on the bottom of the shell, a pretensioned spring means driving said rammer and a release mechanism acting on the rammer and absorbing the spring tension in the locked position. In order to reliably absorb high ramming forces in a clearance-free manner and so as to suddenly release the same with a limited force requirement, the release mechanism has a fixedly mounted gripper, which cooperates by a planar effective surface with a planar opposite surface on the rammer. The effective surface and the opposite surface are in each case one face of a freely rotatably mounted polyhedron and, in the locked position, are at an angle less than 90° to the force vector of the spring means. For releasing the rammer, the gripper can be pivoted by a release drive acting at right angles to the force vector.

10 Claims, 3 Drawing Sheets

APPARATUS FOR LOADING SHELLS INTO TUBULAR WEAPONS, PARTICULARLY TANK HOWITZERS

FIELD OF THE INVENTION

The invention relates to an apparatus for loading shells into tubular or barrel weapons, particularly tank howitzers, comprising a linearly guided rammer engaging a bottom of the shell, a pretensioned spring means driving the rammer, and a release mechanism acting on the rammer and absorbing the spring tension in the locked position.

BACKGROUND OF THE INVENTION

During the loading of tubular weapons, the shell is manually or mechanically brought into a position upstream of the weapon breech plate, where it rests on a loading tray and its axis is aligned with the barrel bore axis. From this position the shell is accelerated and rammed by the rammer into the tube. Thus, the rammer drive must give the shell a high acceleration over a comparatively short distance, which requires a correspondingly high driving forces and a short-term release thereof.

Spring means, e.g. motor-pretensioned helical springs have proved satisfactory for driving the rammer (EP-A-256 250). In the pretensioned position the spring tension is absorbed by a release mechanism holding back the rammer.

SUMMARY OF THE INVENTION

The aim underlying the invention is to provide an apparatus having the aforementioned construction with a release mechanism which, is reliable of simple and space-saving construction, and is capable of absorbing high pretension or initial stressing forces for a comparatively low release force.

According to the invention, the release mechanism has a fixed gripper, which cooperates by a planar effective surface with a planar opposite surface on the rammer. The effective surface and the opposite surface are in each case one face of a freely rotatably mounted polyhedron, in the locked position, are under at an angle thus than 90° to the force vector of the spring means. For releasing the rammer, the gripper is pivotable by a release drive acting at right angles to the force vector.

The polyhedrons located on the gripper and on the rammer and which can e.g. be in the form of a hexagon, cooperate in the locked position by, in each case, one of their planar faces, which engage on one another. As a result of the planar construction of the effective surface and the opposite surface the pretension force is absorbed on a continuously precisely defined and comparatively large surface area. Due to the fact that the effective surface and the opposite surface extend in the locked position under at an angle of less than 90° to the force vector of the spring, a reliable locking in ensured. The release drive acts on the gripper at right angles to the force vector of the spring and draws the same, accompanied by the rolling of the two polyhedrons, into the release position, so that the polyhedron on the rammer is released and the pretension force of the spring can act suddenly and to its full extent. The release force to be applied by the release drive need only be a fraction of the pretension force due to its path at right angles to the spring force vector. During the moving back of the rammer, in which the spring means is retensioned, the gripper drops in again. Through appropriate constructional means, e.g. a corresponding clearance between the release drive and the gripper, it is ensured that the two polyhedrons roll in a stable position, where they engage on one another via the affective surface and the opposite surface.

In the locked position, the effective surface and the opposite surface advantageously form an angle between 75° and 90° and, preferably, between 80° and 85° with the force vector of the spring means.

Advantageously the force vector of the release drive forms, with the force vector of the spring means, an angle between 75° and 105° and can, in particular, be roughly under substantially the same angle as the effective surface and the opposite surface in the locked position. This makes it possible to reduce the necessary release force of the release drive to less than 1/15 of the pretensioned force.

The force vector of the release drive and the force vector of the spring means appropriately form a somewhat smaller angle than the latter with the effective surface and the opposite surface in the locked position.

Another advantageous embodiment is characterized in that the pivot pin of the polyhedron mounted on the gripper in the locked position is displaced towards the open side of the gripper with respect to a line linking the swivel pin of the gripper and the pivot pin of the other polyhedron.

As a result of the aforementioned, construction the two polyhedrons are in a beyond dead-center position in the locked state, so that the pretension force contributes to maintaining the gripper in the locked state and the polyhedrons only have to be brought beyond the dead-center position on release.

Advantageously the release drive engages via a tie rod on the gripper. The release drive can e.g. be constructed as a short-lift electromagnet, which acts on the tie rod by an optionally speed-increasing lever system.

According to the invention, the release drive acts on the tie rod by means of a pin guided in a slot extending the longitudinal direction of the rod. Due to this connection between the release drive and the tie rod, the clearance necessary for a completely satisfactory "locking" of the polyhedrons in the locked position is provided.

It is also advantageous if the tie rod is locked in the locked position and e.g. the tie rod can have associated with it a sliding bolt supporting its free end.

This locking effect prevents an untimely release, e.g. to vibrations during firing, travel movements, etc. For loading purposes, the sliding bolt must first be brought into an inactive position, which can e.g. take place electromotively. Only then can the release drive pull the tie rod and therefore swing out the gripper in order to release the pretension force on the rammer.

BRIEF DESCRIPTION OF THE DRAWINGS

The invention is described in greater detail hereinafter relative to an embodiment and the attached drawings, wherein.

DETAILED DESCRIPTION

Figure 1:
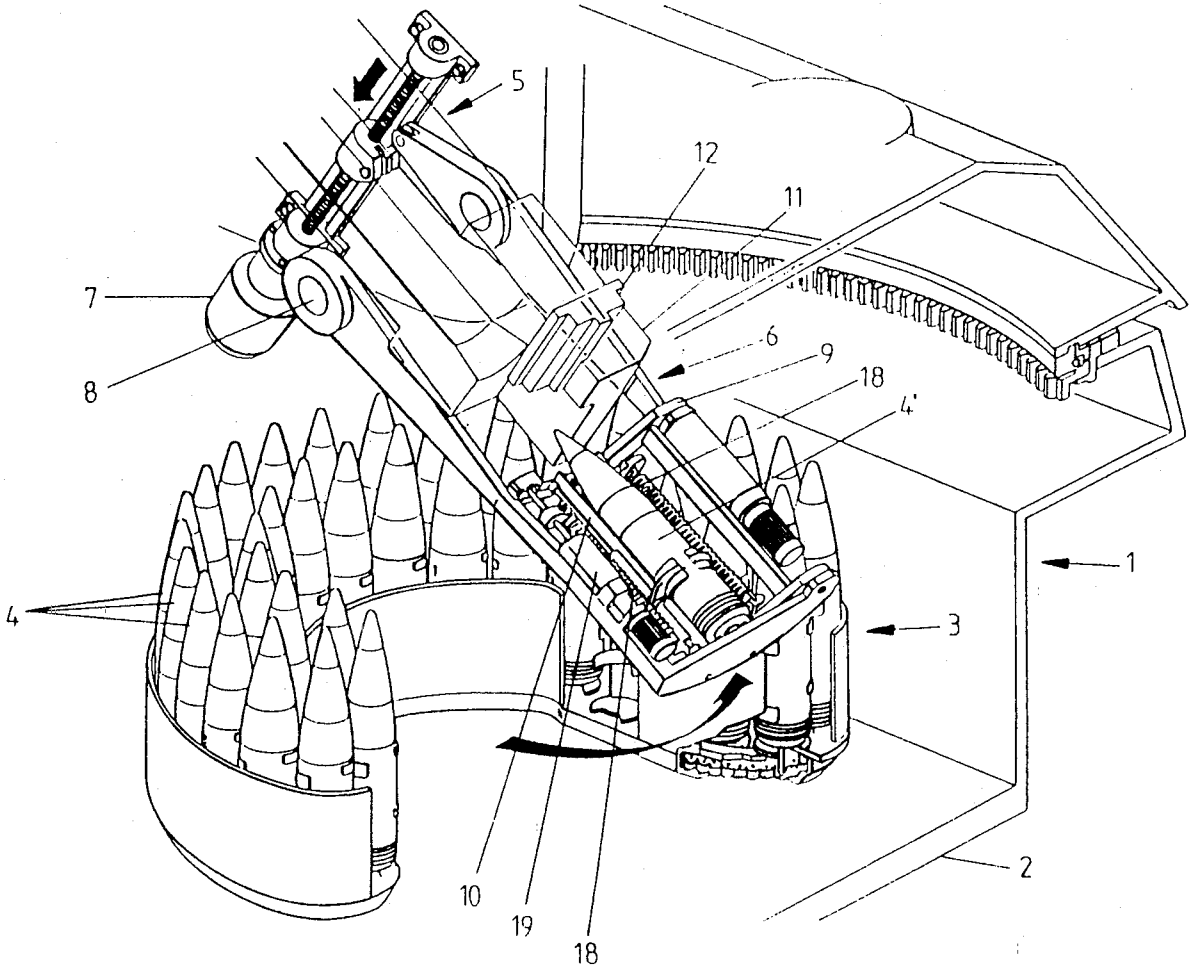
FIG. 1 is a diagrammatic perspective view of a loader on a tank howitzer prior to the loading of a shell.
Figure 2:
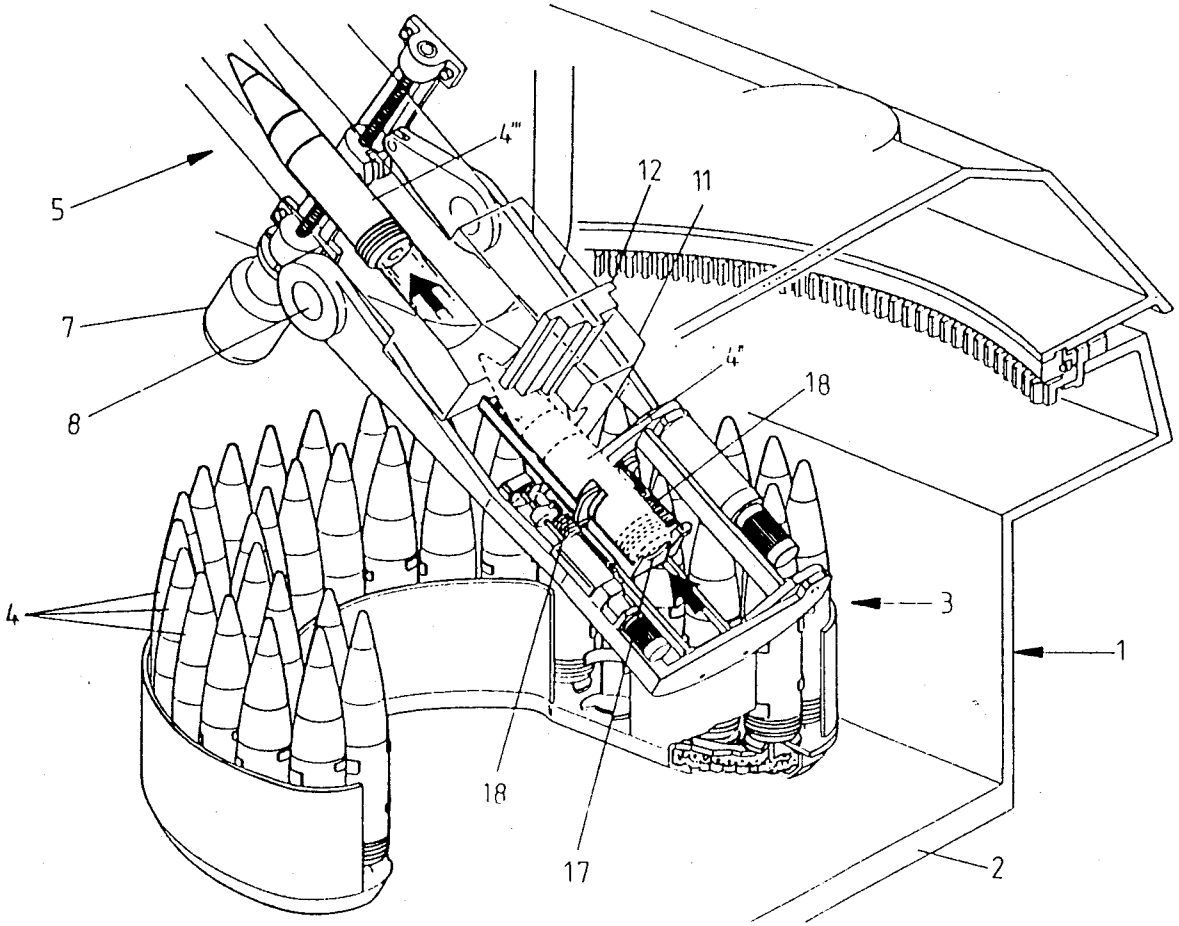
FIG. 2 is a corresponding view during loading.

FIGS. 1 and 2 show the turret 1 of a tank, on whose bottom 2 is placed a partial ring-shaped magazine 3 with vertically arranged shells 4. The weapon 5 is mounted on a cradle (not shown), which can be elevated into a vertical plane. On the cradle of the weapon 5 is mounted a loader 6, which can be pivoted by a drive 7 about a shaft 8 and from a roughly vertical position, where a shell 4' can be removed from the magazine 3 by a loading arm 9 which can be swung out, into the loading position shown. In this position, the shell 4' on a loading tray 10 is in the ramming or loading position upstream of the breech plate 11 or the breech block 12 of the weapon 5.

On the loader 6 is arranged a device for ramming the shells and by which the shell is accelerated from the position 4' in FIG. 1 via the broken line position 4'' in FIG. 2 and into the position 4''' in the rifling of the weapon 5. The ramming device has for this purpose a rammer 17 (FIG. 2), which acts on the bottom of the shell. On the actual rammer 17 acts a drive in the form of a spring means, which, in the represented embodiment, comprises two tension springs 18 on either side of the loading tray 10 and which are pretensioned in the position according to FIG. 1 and relaxed following ramming (FIG. 2). A tensioning drive 19 (FIGS. 1 and 3) is associated with the tension spring 18.

Figure 3:
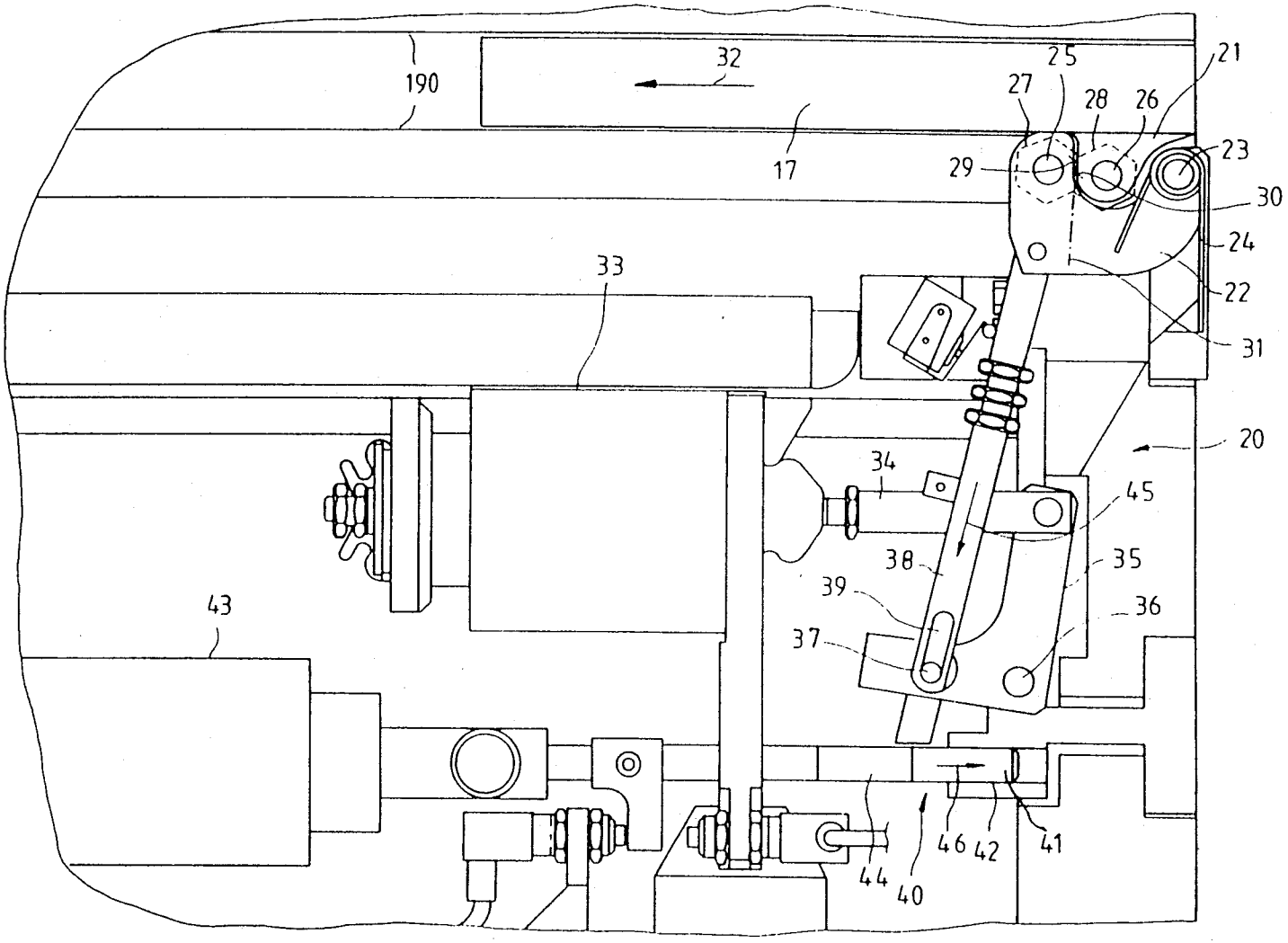
FIG. 3 is an enlarged view of the release mechanism of the rammer.

With the rammer 17 is associated a release mechanism 20 shown in greater detail in FIG. 3 and which, in the ramming position according to FIG. 1 absorbs the forces of reaction of the tension springs 18 and ensures a sudden release of the tension forces. FIG. 3 shows the rammer 17, which runs in a guide 190 on the loader 6. The rammer 17 has a projection 21 extending downwards in FIG. 3 and which cooperates with a gripper 22 of the release mechanism 20. The gripper 22 is pivotably mounted on a bolt 23, which is in turn, e.g. located on the guide 19, and is, subject to the action of a fixedly supported spring clip 24, which forces it into the locked position.

On, in each case, one mounted bolt 25, 26, a polyhedron 27, 28 in the form of a hexagon is located on the gripper 22 and on the projection 21 of the rammer 17. The hexagon 27 on the gripper 22 forms a planar effective surface 29, which cooperates with a planar opposite surface 30 on the hexagon. In the ramming position shown in FIG. 3 the effective surface 29 and the opposite surface 30 press against one another. The contact pressure is defined by the pretension of the tension springs 18. By the gripper 22 the pretension is absorbed in the guide 190.

The gripper 22 and the projection 21 or the polyhedron 27, 28 are so associated with one another that the common plane 31 of the effective surface 29 and the opposite surface 30 forms with the force vector indicated by the arrow 32 in FIG. 3 an angle of less than 90°. In addition, the rotation axis of the pivot pin 25 on the gripper 22 is upwardly displaced compared with that of the pivot pin 26, as well as with respect to the swivel axis predetermined by the bolt 23 of the gripper 22. Thus, a beyond dead-center position is obtained in the locked state and this prevents an untimely release of the rammer 17.

The release mechanism 20 has a release drive 33, e.g. an electromagnet, which acts by a tie rod 34, on an angle lever 35. The latter angle lever 35 is, in turn, mounted at 36 and engages by a bolt 37 fixed thereto on a tie rod 38, which has a slot 39 guiding the bolt 37. The tie rod 38, whose length is adjustable for setting purposes, is connected in articulated manner to the gripper 22. The tie rod is moved by the release drive in the direction of the force vector 45, which forms with the force vector 32 of the tension springs 18 an angle less than 90°. This angle is advantageously less than an angle formed by the plane 31 of the effective surface 29 and the opposite surface 30 with the force vector 32.

In the locked position shown in FIG. 3 which, due to the beyond dead-center position in which the two polyhedrons 27, 28 are located, is intrinsically stable, there is also a locking means 40 for the tie rod 38, in order to maintain the locked position in the case of powerful vibrations. The locking means 40 has a sliding bolt 41, which engages in a fixed guide 42 and is operable by a servomotor 43. The sliding bolt 41 has a recess 44, in which can be inserted the tie rod 38 during the release process and after moving the bolt 41 in the direction of the arrow 46.

The release mechanism 20 functions as follows. In the ramming or loading position shown in FIG. 1, the release mechanism 20 is in the locked position according to FIG. 3. The tension springs 18 on either side of the loading tray 10 are pretensioned. For releasing the rammer 17 the servomotor 43 is firstly energized and moves the sliding bolt 41 in the guide 42 in the direction of the arrow (to the right in FIG. 3), so that the recess 44 comes to rest below the free end of the tie rod 38. The electromagnet forming the release drive 33 is then energized and, by the tie rod 34, the angle lever 35 and the bolt 37 draws the tie rod 38 downwards in the direction of the arrow. The rotatably mounted polyhedrons 27, 28 roll on one another, so that the gripper 22 pivots downwards around the bolt 23 until the polyhedron 28 becomes free on the projection 21 of the rammer 17, so that it is accelerated by the thus released tension springs and the accelerative force is transferred via the bottom to the shell.

Following the loading of the shell (FIG. 2), the tension springs 18 are moved back again into the pretensioned position by the tensioning drive 19. Simultaneously the rammer 17 is returned to the starting position according to FIG. 3. After reaching the end position the tie rod 38 is forced upwards in the direction opposite to the arrow by the release drive 33 and the gripper 22 is carried with it until contact occurs between the polyhedrons 27, 28. They then once again roll on one another until the effective surface 29 and the opposite surface 30 engage with one another and the gripper is secured. The clearance necessary for the entry of the two polyhedrons 27, 28 is ensured by the slot 39. If the gripper 22 is in the locked position according to FIG. 3, once again the servomotor 43 is operated and the sliding bolt 41 is drawn into the locking position according to FIG. 3.

I claim:

1. Apparatus for loading shells in tubular weapons, the apparatus comprising:

a linearly guided rammer engageable with a bottom of the shell;

a pretensioned spring for driving said rammer;

a release mechanism engageable with the rammer and adapted to absorb a spring tension of the pretensioned spring in a locked position of the rammer, the release mechanism includes a pivotally mounted gripper having a first polyhedron freely rotatably mounted thereon;

a projecting portion provided on said rammer and including a second polyhedron freely rotatably mounted thereon, wherein said gripper and said projecting portion are disposed such that said first and second polyhedrons are arranged in opposition to each other with surfaces of the first polyhedron defining effective surfaces and surfaces of the second polyhedron defining opposed surfaces, the respective effective surfaces and opposite surfaces, in the locked position of the rammer are arranged at an angle of less than 90° with respect to a force vector of the pretensioned spring, and wherein a release drive, acting at right angles to the force vector of the pretensioned spring, pivots the gripper for releasing the rammer from the locked position.

2. Apparatus according to claim 1, wherein a force vector of the release drive and the force vector of the pretensioned spring form an angle less than the angle between the effective surface and the opposite surface in the locked position.

3. Apparatus according to claim 1, wherein the effective surface and the opposite surface form with the force vector of the pretensioned spring an angle in a range of 75° to 90° in the locked position.

4. Apparatus according to one of claims 1 or 3, wherein a force vector of the release drive forms an angle in a range of 75° and 105° with the force vector of the pretensioned spring.

5. Apparatus according to one of claims 1 or 3, wherein the first polyhedron is mounted on the gripper by a pivot pin, and the second polyhedron is mounted on the projecting portion by a pivot pin, and wherein the pivot pin of the first polyhedron is displaced in a direction of an open side of the gripper in the locked position with respect to a line connecting a pivot pin of the gripper and the pivot pin of the second polyhedron.

6. An apparatus according to one of claims 1 or 3, wherein the tubular weapons include tank howitzers.

7. Apparatus according to one of claims 1 or 3, wherein the gripper includes a tie rod engageably by the release drive so as to pivot said gripper.

8. Apparatus according to claim 7, wherein the tie rod includes a guide slot accommodating a bolt, said slot extends in a longitudinal direction of the tie rod, and wherein the release drive engages the tie rod by said bolt.

9. Apparatus according to claim 8, wherein means are provided for locking the tie rod in a locked position.

10. Apparatus according to claim 9, wherein said means for locking the tie rod includes a sliding bolt supporting a free end of the tie rod.

* * * * *